United States Patent [19]

Ansted et al.

[11] 4,142,374

[45] Mar. 6, 1979

[54] DEMAND DEFROST TIME CLOCK CONTROL CIRCUIT

[75] Inventors: Roger C. Ansted; Roger W. Dougan, both of San Antonio, Tex.

[73] Assignee: Wylain, Inc., Dallas, Tex.

[21] Appl. No.: 834,134

[22] Filed: Sep. 16, 1977

[51] Int. Cl.[2] ..... F25D 21/06; F25D 21/00

[52] U.S. Cl. ..... 62/155; 62/234

[58] Field of Search ..... 62/151, 155, 156, 157, 62/158, 234

[56] References Cited

U.S. PATENT DOCUMENTS

| | | | |
|---|---|---|---|
| Re. 26,596 | 6/1969 | Jobes | 165/29 X |
| 2,730,336 | 1/1956 | Shiers | 62/157 X |
| 3,277,662 | 10/1966 | Winters | 62/155 |
| 3,282,065 | 11/1966 | Flanagan | 62/234 X |
| 3,312,081 | 4/1967 | Berger et al. | 62/158 |
| 3,455,119 | 7/1969 | Bright | 62/234 X |
| 3,460,352 | 8/1969 | Lorenz | 62/155 X |
| 3,461,681 | 8/1969 | Smith et al. | 62/155 X |
| 3,465,535 | 9/1969 | Dodge | 62/151 |
| 3,495,416 | 2/1970 | Morrissey, Jr. et al. | 62/156 X |
| 3,529,431 | 9/1970 | Kusuda et al. | 62/156 X |
| 3,546,894 | 12/1970 | Esche | 62/157 X |
| 3,578,754 | 5/1971 | Kusuda et al. | 62/234 X |
| 3,583,173 | 6/1971 | Chesebro | 62/158 |
| 3,643,458 | 2/1972 | Linstrongerg et al. | 62/234 |
| 3,681,933 | 8/1972 | Check, Jr. | 62/156 |
| 3,733,841 | 5/1973 | Gelbard | 62/157 X |
| 3,759,049 | 9/1973 | Bell et al. | 62/155 X |
| 3,826,103 | 7/1974 | Crover | 62/156 X |
| 3,839,878 | 10/1974 | Tilmanis | 62/155 |
| 3,894,404 | 7/1975 | Stanton | 62/155 |
| 3,899,895 | 8/1975 | Blanton et al. | 62/234 |
| 3,965,692 | 6/1976 | Ansted et al. | 62/234 X |
| 3,992,895 | 11/1976 | Kramer | 62/155 |

FOREIGN PATENT DOCUMENTS

| | | | |
|---|---|---|---|
| 1094486 | 5/1955 | France | 62/151 |

*Primary Examiner*—Leslie Braun

*Attorney, Agent, or Firm*—Lane, Aitken & Ziems

[57] ABSTRACT

A method and apparatus for initiating the defrost of refrigeration equipment on demand. A defrost clock which normally controls the conventional refrigeration and defrost modes of a refrigeration system includes an auxiliary switch to cease operation of the clock motor a predetermined time prior to normal defrost initiation. The defrost clock thus remains in the refrigeration mode until the demand defrost sensor switch, or an optional demand switch, initiates a defrost cycle of the refrigeration equipment. The closure of the demand defrost switch or the optional switches causes the defrost clock motor to run for a predetermined short period of time. The defrost clock switch subsequently closes slightly prior to initiation of a defrost to guarantee that the clock runs throughout the defrost mode. Thereafter, the defrost clock controls the length of the defrost and will terminate defrost upon a signal from a thermostat, or by a time signal, or a pressure signal. The auxiliary switch remains closed after termination to allow the defrost clock to repeat the previous sequence of operation.

7 Claims, 7 Drawing Figures

FIG. 1.

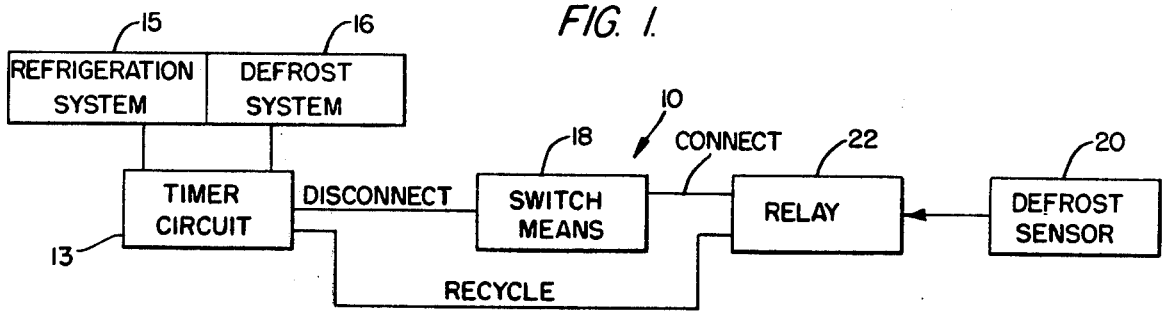

FIG. 2.

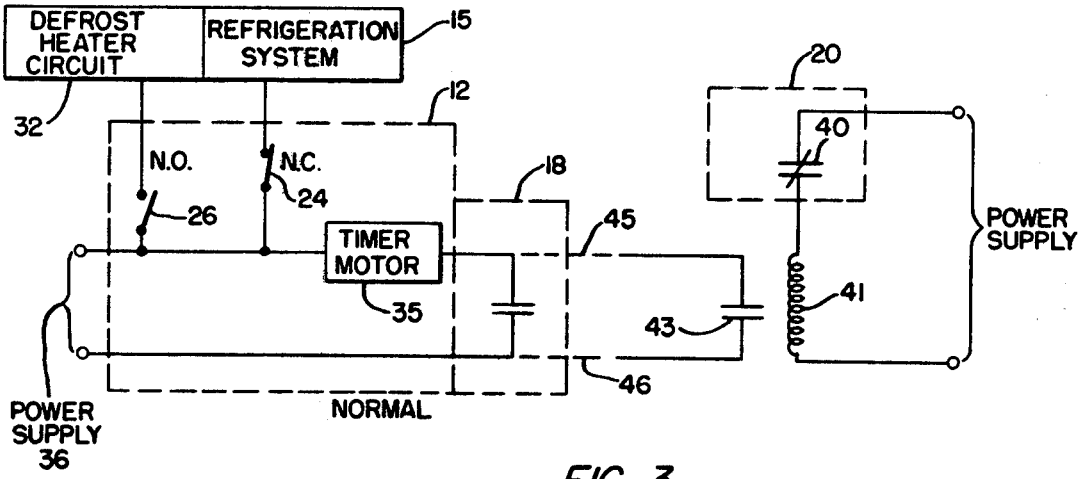

FIG. 3.

| | CLOCK MOTOR 35 | CLOCK POSITION | SWITCH 18 | RELAY CONTACT 43 | DEFROST SWITCH 40 |
|---|---|---|---|---|---|
| NORMAL | OFF | REFRIGERATION | OPEN | OPEN | CLOSED |
| CALL FOR DEFROST | ON | REFRIGERATION | OPEN | CLOSED | OPEN |
| 20 MIN. LATER | ON | REFRIGERATION | CLOSED | CLOSED | OPEN |
| 10 MIN. LATER | ON | DEFROST | CLOSED | CLOSED | OPEN |
| RESET DEFROST SWITCH | ON | DEFROST | CLOSED | OPEN | CLOSED |
| DEFROST TERMINATE | ON | REFRIGERATION | CLOSED | OPEN | CLOSED |
| ΔT BEFORE NEXT CYCLE (SAME AS NORMAL) | OFF | REFRIGERATION | OPEN | OPEN | CLOSED |

DEMAND DEFROST TIME CLOCK CONTROL CIRCUIT

BACKGROUND OF THE INVENTION

This invention relates broadly to a demand defrost time clock control circuit for refrigeration systems. More particularly, this invention relates to a method and apparatus for controlling the defrost cycle in a refrigeration system to initiate defrost on demand rather than by time. More particularly, this invention relates to a method and apparatus for initiating defrost on demand by terminating operation of a conventional clock timer motor prior to initiation of an otherwise timebound defrost whereupon the defrosting unit operates by and in response to a demand of the system for defrosting.

Systems are known to the art for controlling the defrost of one or a plurality of refrigeration units. Such systems operate generally at either regular timed intervals or upon a demand based upon the sensing of a frost accumulation on the refrigeration coils of the unit or in response to other frost accumulation parameters. A typical time demand type of system includes a conventional, commercially available defrost clock having a timer motor to initiate defrost on a periodic basis. For example, in a typical sequence, the clock timer motor operates to initiate two defrosts per day by alternatively controlling a compressor in the refrigeration unit and the defrost heaters for the unit. Such systems have proven quite reliable and have achieved significant field acceptance. Moreover, such systems have significant failsafe features.

However, since time bound defrost cycles utilize a significant amount of energy, it is desirable to reduce the energy requirements for defrosting by eliminating unnecessary defrost cycles, or at least reducing their number. Thus, it is an overall aim of this invention to produce a demand defrost control system for refrigeration systems rather than a time bound defrost control system while at the same time continuing to provide the proven reliability, field acceptance, and failsafe features of conventional defrost time clocks. In conjunction with this aim, it is desirable to be able to set a minimum time between defrosts on the clock and to utilize, where desirable, optional multiple sensors at differing sensing points in such a manner that any one of such sensors could initiate a defrost cycle in the refrigeration system.

The reduction in the number of defrosts yields an improved product life and quality as well as the reduction in the energy needed. Energy savings occur because it requires energy to heat the previously refrigerated but frosted area to a temperature high enough to melt the frost, and the heat provided to the refrigerated area during the defrost cycle must be removed at the end of the defrosting period. By way of example, the process of removing the defrost heat in a refrigeration unit typically takes about the same amount of energy as it takes to melt the frost at frozen food and ice cream temperatures.

Thus, it is an overall object of this invention to provide a demand defrost initiated cycle utilizing a conventional defrost clock and conventional defrost sensors.

These and other objects and aims of the invention will become apparent from the review of the following written description taken in conjunction with the accompanying drawings.

SUMMARY OF THE INVENTION

A demand defrost control circuit according to the invention is particularly adapted for use with a refrigeration system having defrost means. The control circuit comprises a conventional defrost control time clock of the type which includes a timer motor. The operation of the timer motor generally controls the alternative operation of the refrigeration system and the defrost means within the refrigeration system. According to the invention, the defrost clock includes auxiliary switching means in circuit with the timer motor in the defrost control clock and arranged so that prior to a normal time responsive defrost initiation, the switch means causes the operation of the timer motor to cease. During this period, if all of the defrost demand switches are open, the clock motor will stop. The defrost control clock circuit remains in the refrigeration mode and the refrigeration system operates normally until the demand defrost switch or any optional second switch is actuated to cause the clock motor to run for a predetermined period of time to initiate a defrost.

During this period, the auxiliary switch means which suspended the operation of the clock timer motor closes approximately ten (10) minutes prior to a defrost heater initiation from the defrost clock circuit to guarantee that the clock continues to run when the defrost clock control circuit is in the defrost mode.

After the timer clock is in its defrost mode and the auxiliary switch means has actuated to cause the clock motor to continue to run, the defrost clock circuit will continue to control the length of the defrost. Thereafter, the clock will terminate defrost upon a signal from a thermostat or by sensing the pressure of the refrigerant in the system or by time. The auxiliary switch in circuit with the defrost control timer will remain closed to allow the defrost clock to repeat the previous sequence of operation.

BRIEF DESCRIPTION OF THE DRAWINGS

In the drawings:

FIG. 1 is a simplified block diagram indicating the functional interconnections of the basic components of the invention;

FIG. 2 is a drawing similar to FIG. 1 showing in greater detail the components of the defrost control circuit and the defrost sensor in the normal refrigeration mode;

FIG. 3 is a sequencing diagram showing the state of various components of the invention at different stages in the refrigeration and defrost cycle;

DETAILED DESCRIPTION OF THE PREFERRED EMBODIMENT

Figure 4:
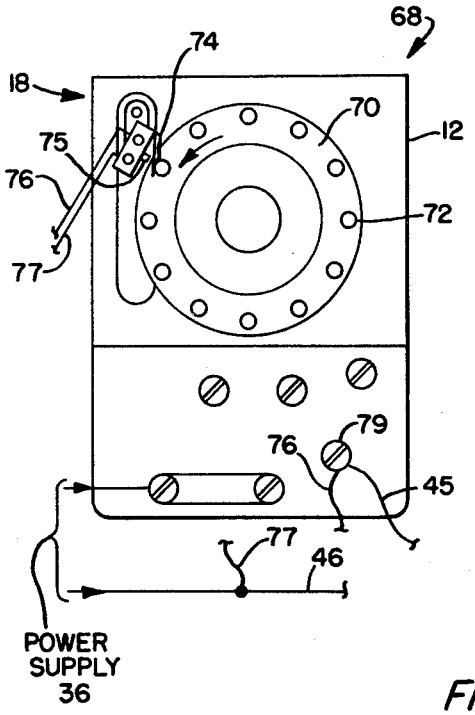
FIG. 4 is a front plan view of housing for a conventional defrost control clock showing the addition of the auxiliary switch means.

In FIG. 1, the demand defrost time clock control circuit according to the invention is shown in a block diagram and is designated generally by the reference numeral 10. The system comprises a conventional defrost control circuit 12 (denoted in FIG. 2 by dashed lines) which includes a clock timer circuit 13. Usually, the timer circuit includes a time component for permitting, according to a predetermined timing cycle, the operation of a compressor of a refrigeration system 15 to refrigerate a space. In addition, the timer circuit 13 controls the alternative and exclusive operation of the defrost system 16 for defrosting the evaporator coils of the refrigeration system 15 upon command from a signal from the timer circuit 13.

The timer circuit 13 normally coordinates the alternative operation of the refrigeration system 15 and the defrost system 16 on a time basis. For example, normally the timer circuit 13 provides one or more defrosts of the refrigeration system in a given day in a manner discussed in greater detail in connection with FIG. 2. The defrost system typically includes heaters for removing frost buildup on the evaporator coils within the refrigeration system. The details of the relationship between the defrost system and the refrigeration system are well known in this art and may vary widely as a function of a particular installation.

An auxiliary switching means 18 is connected to the timer circuit 13 in the defrost control circuit 12 so that the clock motor in the timer circuit 13 is disconnected when the switching means 18 changes its on/off state to permit the defrost control circuit to operate continuously in the refrigeration mode. This effectively suspends the effect of the clock motor in the timer circuit 13, locks out the defrost system pending receipt of a demand defrost signal, and thus causes the defrost control circuit to operate continuously in the refrigeration mode. Thus, the auxiliary switch means 18 functionally disconnects the clock motor in the timer circuit 13 until the timer circuit is recycled in response to a demand defrost signal.

A defrost sensor 20 is operatively associated with the refrigeration system and senses frost accumulation therein, particularly in the evaporator coils. When the sensor is de-activated by frost buildup, a demand defrost signal is provided through an isolating relay 22 which causes the defrost control circuit 12 to initiate a defrost at a predetermined later time. A demand defrost signal thus re-establishes the clock control over the defrost cycle and causes the switch 18 to change to its original on/off state.

The conventional defrost control circuit 12 may be any one of a number of commercially available time clocks for this purpose and the preferred embodiment is an AMF Paragon 8000 series time clock available from Paragon Electric Co., Wisconsin. The effective use of the various models in that series within the teachings of this invention is within the skill of the art. Thus, the differences in those various models, or in other time clocks, need not be elaborated upon.

Such defrost time control circuit includes components for use as a time-initiated defrost control circuit. The defrost termination may be controlled by time, or by pressure in the defrosting evaporator. A time-terminated defrost control operates to cease defrost and re-establish refrigeration at a predetermined time after its initiation of the defrost cycle. A pressure-terminated defrost control operates to cease defrost and re-establish refrigeration when the back pressure of the heated and defrosted evaporator coil builds to a predetermined level. A thermostat may also be used. When used, the thermostat is a close-on-rise switch which operates to terminate the defrost at a predetermined temperature in the refrigeration coils.

As shown in FIG. 2, the defrost control circuit 12 generally includes a normally closed contact or switch 24 in circuit with the refrigeration system 15. A normally open contact or switch 26 is in circuit with the defrost heater circuit 32 which is part of the defrost system 16. A timer motor 35 (a part of the timer circuit 13) is in series with a source of power 36 and with the auxiliary switch means 18. Preferably, the switch means 18 is physically connected to the clock as best seen in FIG. 4 and is actuated about 30 minutes prior to a normal time-based defrost demand.

The demand defrost control 20 is preferably a commercially available unit such as that produced by Altech, Inc. The demand defrost switch 40 is preferably connected to the coil 41 of the relay 22. The relay 22 has a relay coil 41 for energizing a normally closed contact switch 43 which is field connected to the time clock as shown by the dashed leads 45 and 46 respectively and in parallel with the auxiliary switch means 18.

The demand defrost control 20 has a sensor (discussed in connection with FIGS. 5 and 6) mounted on the refrigeration coil which sensor senses frost accumulation. When the frost accumulation reaches a set point on the sensor, the demand defrost switch 40 is opened thus de-energizing the relay coil 41. The demand defrost switch resets automatically when the frost accumulation falls below the reset point.

The operation of the circuit is as follows, as summarized by the chart in FIG. 3. In normal operation, the clock motor 35 is off and the refrigeration system is operating normally. The switch 18 is open as is the relay switch 43. The frost sensor switch 40 is closed. When the frost sensor calls for a defrost cycle, the demand defrost switch 40 opens causing the relay coil 41 to be de-energized to close the contact 43. This in turn bypasses the open microswitch 18 to energize the timer motor 35 to operate the clock in the timer circuit 13. During an intervening period, the refrigeration system operates normally and the clock has no effect as yet on initiating the defrost cycle. At a predetermined time after the sensor switch calls for defrost, such as 20 minutes, the auxiliary switch 18 closes and the demand defrost switch 40 remains open. At a later predetermined time following a demand defrost signal, such as 30 minutes, the clock position which is now operating as described above, has advanced into a defrost position. This means that the normally closed contact 24 is open and the normally open contact 26 is closed as controlled by the time clock. This causes the defrost heater to begin the defrost cycle while opening the refrigeration circuit. It should be understood that in the art there are a number of alternative methods of coordinating the refrigeration cycle with the defrost cycle and the one shown in FIG. 1 is representative.

During the defrost, the sensor switch 40 recloses when the frost accumulation falls below the automatic reset point which opens relay switch 43. The clock position for system operation remains in a defrost mode and the auxiliary switch 18 remains closed allowing the clock motor to continue to run.

After the passage of time, the actual defrost of the refrigeration system is terminated by the operation of the clock position or other termination means to cause the defrost clock to operate in the refrigeration mode. This occurs by closing the contact 24 and opening the contact 26. During this period, the microswitch 18 and the sensor switch 40 remain in their previous positions.

The system remains on refrigeration until a period of 30 minutes or so before the next defrost at which time the microswitch 18 opens to repeat the cycle.

The prior example assumed that the demand defrost switch 40 was closed at the predetermined time prior to a time demand for defrost. Assuming that the demand switch 40 is open at the time the microswitch 18 is open, the defrost clock motor will continue to run for 30 minutes and initiate a normal defrost. In a normal situation, none of the demand switches is closed, and the clock motor will stop until such time as the demand switch closes to allow the clock to run for the remaining portion of the cycle. It has been found advantageous to initiate operation by setting the defrost clock for the normally required number of defrosts per day and causing the microswitch to close 30 minutes before a defrost initiation period.

As described above, the microswitch 18 closes a few minutes prior to initiation to guarantee that the clock runs when the clock is in the defrost mode. This feature has been found advantageous to insure that the operation is failsafe as controlled by the clock.

The circuit of FIGS. 1 and 2 has an advantage in permitting the setting of a maximum time between defrosts. This is accomplished by using a time proportioning control that closes a switch (not shown) in parallel with the demand defrost switch a percentage of the total time. In such circumstances, the clock motor is allowed to run only a percentage of the time. For example, if the percentage closed is 1%, it will take 3000 minutes or 50 hours to initiate a defrost unless the demand switch 40 closes before the 50 hours are up. Under this modification, the defrost cycle would seldom be initiated in the absence of a demand which assures reasonably frost free circumstances.

FIG. 4 is a front plan view of the housing of a conventional time clock defrost control circuit, showing the mounting of the auxiliary switch 18 thereto. The clock, designated in this view by the reference numeral 68, includes a rotatable dial 70 having a plurality of openings for receiving pins therein. The physical placement of a pin in a particular opening 72 in the dial 70 determines the time of day a time-based defrost cycle will be required. Typically, the dial 70 rotates completely in a 24 hour period. The auxiliary microswitch is physically secured, as by screws, to the housing so that the actuatable switch lever 74 may be contacted by a pin in an opening 72. When so urged, the lever 74 depresses pin contact 75 to open the microswitch and the circuit operates as previously described. The leads 76 and 77 from the switch 18 are connected to the relay contact leads 45 and 46 at terminal motor lead 79 and one side of the power supply 36 as previously described.

Figure 5:
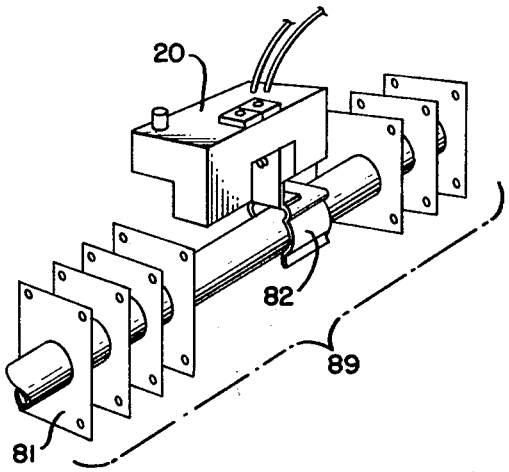
FIG. 5 shows the positioning of the demand defrost switch attached to a portion of the refrigeration unit.

The demand defrost switch 20 is conveniently mounted on the evaporator coil 89 of the refrigeration unit as shown in FIG. 5. The coil includes a plurality of fins 81, several of which are removed upstream relative to the air flow (FIG. 6) from the defrost switch 20 to insure air flow over the sensor if fhe face of the coil blocks.

Figure 6:
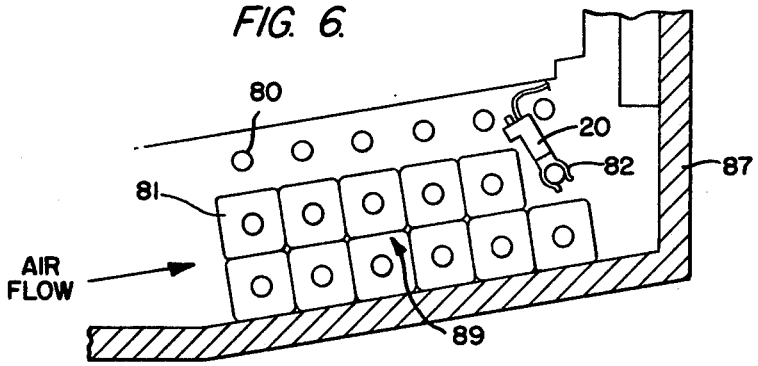
FIG. 6 is a partial view, partially in section, of the casing and radiating fins of a refrigeration unit further showing the positioning of the demand defrost sensor.

FIG. 6 is a side view showing the application of the frost sensor 20 as described in connection with FIG. 5 within a housing 87 accommodating the evaporator coil. In the embodiment shown in FIG. 6, the sensor element 20 is mounted by a spring clip 82. However, other means for securing the sensor are well known.

Figure 7:
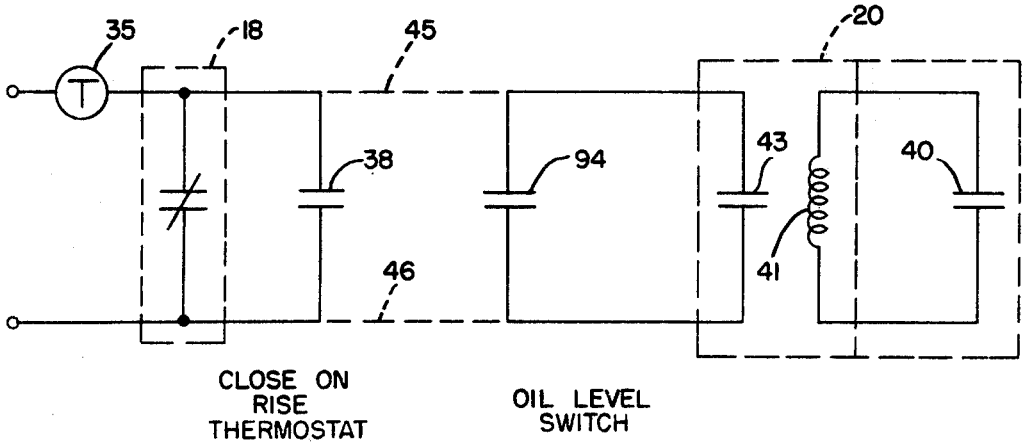
FIG. 7 is a partial circuit diagram showing the connections of additional switches in parallel with the demand defrost switch.

FIG. 7 shows the addition of an optional switch and a circuit position for the close-on-rise thermostat 38 to provide additional failsafe features for the circuit.

The close-on-rise thermostat 38 can be set at a safety setting for measuring the temperature of return air or of some other critical location. If the temperature exceeds the set point, the thermostat contacts will close and start the clock motor 35 running without the demand defrost switch 20 calling for a defrost. The thermostat setting must be high enough to reset after the refrigeration system has defrosted and refrigerated to operating temperatures.

An oil level switch 94, which closes upon a drop in oil level, may also be added. The oil level switch 94 will start the time clock motor operating regardless of any other demand signal. Generally, if a system is allowed to go through one or more time initiated defrosts, the oil in the system will return to the compressor and reset the oil level switch. This control arrangement may be desirable for ice cream freezer systems. Systems designed for warmer temperatures generally do not have oil return problems.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. A demand defrost control circuit for a refrigeration system which includes refrigeration means and defrost means for defrosting said refrigeration means, said circuit comprising:

defrost control means, including a defrost control time clock for coordinately controlling the operation of said refrigeration means and said defrost means, said control time clock normally switching between said refrigeration means and said defrost means at regular timed intervals;

auxiliary switching means in circuit with said defrost control means for interrupting the operation of said time clock in the absence of a demand defrost signal at a predetermined time prior to switching to said defrost means, whereupon said defrost means remains substantially inhibited and said refrigeration means remains operative until the presence of a demand defrost signal whereupon said refrigeration means is inhibited; and demand defrost means, including means for sensing frost in said refrigeration means, operatively associated with said refrigeration means and said defrost control means for generating the demand defrost signal in response to said frost sensing means, said demand defrost signal activating said time clock to cause the clock to run said predetermined time until said defrost control means is activated by said clock to control the operation of said defrost means and to inhibit said refrigeration means.

2. The circuit as set forth in claim 1 wherein said switching means is normally in a first on-off state and switches to an opposite on-off state at a predetermined time prior to a normal demand for defrost by said defrost control means responsive to said clock.

3. The circuit as set forth in claim 4 wherein said switching means switches from said opposite on-off state to said first on-off state at about when said defrost control means receives said demand defrost signal.

4. The circuit as set forth in claim 1 wherein said frost sensing means is located in said refrigeration means for sensing frost therein.

5. The circuit as set forth in claim 1 further including a second switching means in parallel with said auxiliary switching means for sensing an alternative parameter such as oil level and/or temperature initiating defrost responsive thereto to inhibit refrigeration.

6. In a refrigeration system of the type which includes the combination of refrigeration means and defrost means for defrosting said refrigeration means upon command, a time clock which includes a timer motor for commanding said defrost means to defrost said refrigeration means at regular timed intervals, and a source of power for operating said time clock, the improvement comprising the combination of:

auxiliary switch means in circuit with said time clock and arranged to disconnect said timer motor at a predetermined time prior to one of said regular timed intervals for defrost; and demand defrost means for sensing frost accumulation in said refrigeration means and providing a demand defrost signal responsive thereto, said demand defrost signal acting to reconnect said timer motor to cause said time clock to command a defrost cycle after said predetermined time prior to said regular timed interval;

whereupon a time-based defrost control circuit is converted to a demand defrost control circuit.

7. A method for converting a time-based defrost control clock to a demand defrost control, the defrost control clock including means for commanding the defrosting of a refrigeration system and a time clock operated by a timer motor for normally initiating the defrosting of said refrigeration system at regular timed intervals, comprising the steps of:

connecting an auxiliary switch to said defrost control clock in such a manner that said timer motor is disconnected at a predetermined time prior to a normal time-based defrost control signal; and connecting a demand defrost switch to said time clock in such a manner that said timer motor is reconnected upon a demand for defrosting to command a defrost cycle after said motor has been reconnected for said predetermined time.

* * * * *

UNITED STATES PATENT AND TRADEMARK OFFICE

CERTIFICATE OF CORRECTION

PATENT NO. : 4,142,374

DATED : March 6, 1979

INVENTOR(S) : Roger C. Ansted et al.

It is certified that error appears in the above-identified patent and that said Letters Patent are hereby corrected as shown below:

The drawing shown on the cover sheet of the patent does not pertain to this case and should be deleted entirely and the drawing firure as shown below substituted therefor.

Column 6, line 67, "4" should read --- 2 ---.

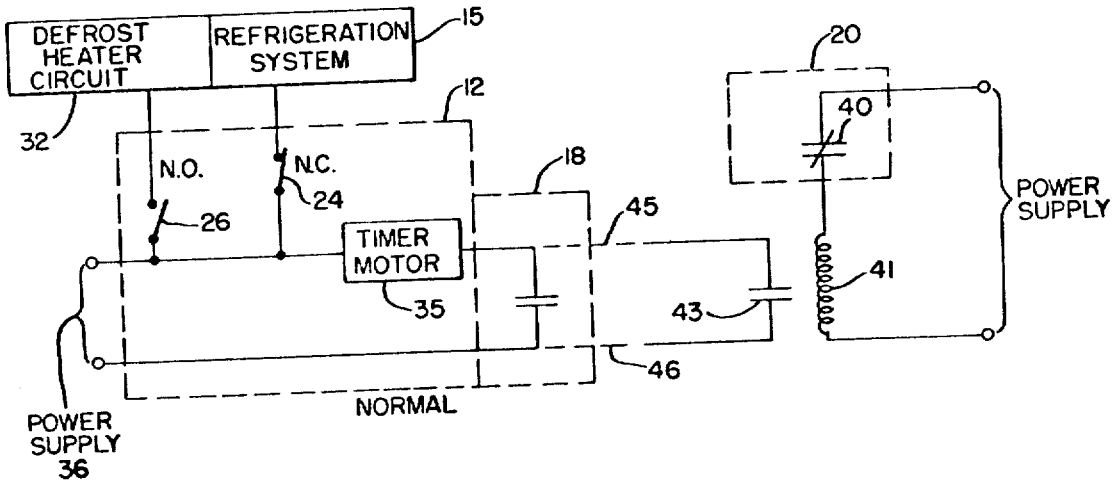

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*